US007369995B2

(12) United States Patent
Ferencz et al.

(10) Patent No.: US 7,369,995 B2
(45) Date of Patent: May 6, 2008

(54) METHOD AND APPARATUS FOR SYNTHESIZING SPEECH FROM TEXT

(75) Inventors: Attila Ferencz, Gyeonggi-do (KR); Jeong-su Kim, Gyeonggi-do (KR); Jao-won Lee, Seoul (KR)

(73) Assignee: Samsung Electonics Co., Ltd., Suwon-Si (KR)

( * ) Notice: Subject to any disclaimer, the term of this patent is extended or adjusted under 35 U.S.C. 154(b) by 799 days.

(21) Appl. No.: 10/785,113

(22) Filed: Feb. 25, 2004

(65) Prior Publication Data

US 2004/0167780 A1 Aug. 26, 2004

(30) Foreign Application Priority Data

Feb. 25, 2003 (KR) ..... 10-2003-0011786

(51) Int. Cl.
*G10L 13/02* (2006.01)

(52) U.S. Cl. ..... 704/260; 704/258

(58) Field of Classification Search ..... 704/260, 704/258

See application file for complete search history.

(56) References Cited

U.S. PATENT DOCUMENTS 5,490,234 A 2/1996 Narayan
5,592,585 A * 1/1997 Van Coile et al. ..... 704/206
5,617,507 A * 4/1997 Lee et al. ..... 704/200
5,642,466 A * 6/1997 Narayan ..... 704/260
5,978,764 A * 11/1999 Lowry et al. ..... 704/258
6,067,519 A 5/2000 Lowry
6,175,821 B1 1/2001 Page et al.
2002/0099547 A1 7/2002 Chu et al.
2002/0143526 A1 10/2002 Coorman et al.

OTHER PUBLICATIONS

E. Rank, "Exploiting Improved Parameter Smoothing Within a Hybrid Concatenative/LPC Speech Synthesizer", 6th European Conference on Speech Communication and Technology (Eurospeech '99), pp. 2339-2342, Budapest, Hungary, Sep. 5-9, 1999.
D. Chappell and J. Hansen, "Spectral Smoothing For Concatenative Speech Synthesis", Proceedings of 1988 International Conference on Spoken Language Processing, 5, pp. 1935-1938, 1998.
"Pitch-synchronous Waveform Processing Techniques for Text-to-Speech Synthesis using Diphones," Molines et al., Dec. 1, 1990, *Speech Communication*, Elsevier Science Publishers, Amsterdam, vol. 9, No. 5/6, pp. 453-467.

* cited by examiner

*Primary Examiner*—Daniel Abebe
(74) *Attorney, Agent, or Firm*—Staas & Halsey LLP

(57) ABSTRACT

A speech synthesis method, in which speech units are concatenated using a DB, wherein the speech units to be concatenated are determined and divided into a left speech unit and a right speech unit. The length of an interpolation region of each of the left and right speech units is variably determined. An extension is attached to a right boundary of the left speech unit and an extension to a left boundary of the right speech unit. The locations of pitch marks included in the extension of each of the left and right speech units are aligned so that the pitch marks can fit in the predetermined interpolation region. The left and right speech units are superimposed after fading out the left speech unit and fading in the right speech unit. Accordingly, a determination of whether extra-segmental data exists or not is made, and smoothing concatenation is performed using either an interpolation of existing data or an interpolation of extrapolated data depending on the result of the determination.

16 Claims, 14 Drawing Sheets

METHOD AND APPARATUS FOR SYNTHESIZING SPEECH FROM TEXT

CROSS-REFERENCE TO RELATED APPLICATIONS

This application claims the benefit of Korean Patent Application No. 2003-11786, filed on Feb. 25, 2003, in the Korean Intellectual Property Office, the disclosure of which is incorporated herein by reference.

BACKGROUND OF THE INVENTION

1. Field of the Invention

The present invention relates to Text-to-Speech Synthesis (TTS), and more particularly, to a method and apparatus for smoothed concatenation of speech units.

2. Description of the Related Art

Speech synthesis is performed using a Corpus-based speech database (hereinafter, referred to as DB or speech DB). Recently, speech synthesis systems perform suitable speech synthesis according to their system specifications, such as, DB size. For example, since large-size speech synthesis systems contain a large size DB, they can perform speech synthesis without pruning speech data. However, every speech synthesis system cannot use a large size DB. In fact, mobile phones, personal digital assistants (PDAs), and the like can only use a small size DB. Hence, these apparatuses focus on how to implement good-quality speech synthesis while using a small size DB.

In a concatenation of two adjacent speech units during speech synthesis, reducing acoustical mismatch is the first thing to be achieved. The following conventional arts deal with this issue.

U.S. Pat. No. 5,490,234, entitled "Waveform Blending Technique for Text-to-Speech System", relates to systems for determining an optimum concatenation point and performing a smooth concatenation of two adjacent pitches with reference to the concatenation point.

U.S. Patent Application No. 2002/0099547, entitled "Method and Apparatus for Speech Synthesis without Prosody Modification", relates to speech synthesis suitable for both large-size DB and limited-size DB (namely, from middle- to small-size DB), and more particularly, to a concatenation using a large-size speech DB without a smoothing process.

U.S. Patent Application No. 2002/0143526, entitled "Fast Waveform Synchronization for Concatenation and Time-scale Modification of Speech", relates to limited smoothing performed over one pitch interval, and more particularly, to an adjustment of the concatenating boundary between a left speech unit and a right speech unit without accurate pitch marking.

In a concatenation of two adjacent voiced speech units during speech synthesis, it is important to reduce acoustical mismatch to create a natural speech from an input text and to adaptively perform speech synthesis according to the hardware resources for speech synthesis.

SUMMARY OF THE INVENTION

The present invention provides a speech synthesis method by which acoustical mismatch is reduced, language-independent concatenation is achieved, and good speech synthesis can be performed even using a small-size DB.

The present invention also provides a speech synthesis apparatus which performs the speech synthesis method.

According to an aspect of the present invention, there is provided a speech synthesis method in which speech units are concatenated using a DB. In this method, first, the speech units to be concatenated are determined, and all voiced pairs of adjacent speech units are divided into a left speech unit and a right speech unit. Then, the length of an interpolation region of each of the left and right speech units is variably determined. Thereafter, an extension is attached to a right boundary of the left speech unit and an extension is attached to a left boundary of the right speech unit. Next, the locations of pitch marks included in the extension of each of the left and right speech units are aligned so that the pitch marks can fit in the predetermined interpolation region. Finally, the left and right speech units are superimposed.

According to one aspect of the present invention, the boundary extension operation comprises the sub-operations of: determining whether extra-segmental data of the left and/or right speech units exists in the DB; extending the right boundary of the left speech unit and the left boundary of the right speech unit by using existing data if the extra-segmental data exists in the DB; and extending the right boundary of the left speech unit and the left boundary of the right speech unit by using an extrapolation if no extra-segmental data exists in the DB.

According to one aspect of the present invention, equi-proportionate interpolation of the pitch periods included in the predetermined interpolation region may be performed between the pitch mark aligning operation and the speech unit superimposing operation.

According to another aspect of the present invention, there is provided a speech synthesis apparatus in which speech units are concatenated using a DB. This apparatus comprises a concatenation region determination unit for voiced speech units, a boundary extension unit, a pitch mark alignment unit, and a speech unit superimposing unit. The concatenation region determination unit determines the speech units to be concatenated, divides the speech units into a left speech unit and a right speech unit, and variably determines the length of an interpolation region of each of the left and right speech units. The boundary extension unit attaches an extension to a right boundary of the left speech unit and an extension to a left boundary of the right speech unit. The pitch mark alignment unit aligns the locations of pitch marks included in the extension of each of the left and right speech units so that the pitch marks can fit in the predetermined interpolation region. The speech unit superimposing unit superimposes the left and right speech units.

According to another aspect of the present invention, the boundary extension unit determines whether extra-segmental data of the left and/or right speech units exists in the DB. If the extra-segmental data exists in the DB, the boundary extension unit extends the right boundary of the left speech unit and the left boundary of the right speech unit by using the stored extra-segmental data. On the other hand, if no extra-segmental data exists in the DB, the boundary extension unit extends the right boundary of the left speech unit and the left boundary of the right speech unit by using an extrapolation.

According to another aspect of the present invention, the speech synthesis apparatus further comprises a pitch track interpolation unit. The pitch track interpolation unit receives a pitch waveform from the pitch mark alignment unit, equi-proportionately interpolates the periods of the pitches included in the interpolation region, and outputs the result of equi-proportionate interpolation to the speech unit superimposing unit.

According to another aspect of the present invention, there is provided a computer readable medium encoded with processing instructions for performing a method of speech synthesis in which speech units are concatenated using a data base, the method comprising: determining the speech units to be concatenated and dividing the speech units into a left speech unit and a right speech unit; variably determining a length of a first interpolation region of the left speech unit and variably determining a length of a second interpolation region of the right speech unit; attaching an extension to a right boundary of the left speech unit and an extension to a left boundary of the right speech unit; aligning locations of pitch marks included in the extension of each of the left and right speech units so that the pitch marks can fit in a third interpolation region; and superimposing the left and right speech units.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 11 shows an example in which a predetermined interpolation region of a left speech unit fades out and a predetermined interpolation region of a right speech unit fades in;

DETAILED DESCRIPTION OF THE PREFERRED EMBODIMENTS

Figure 1:
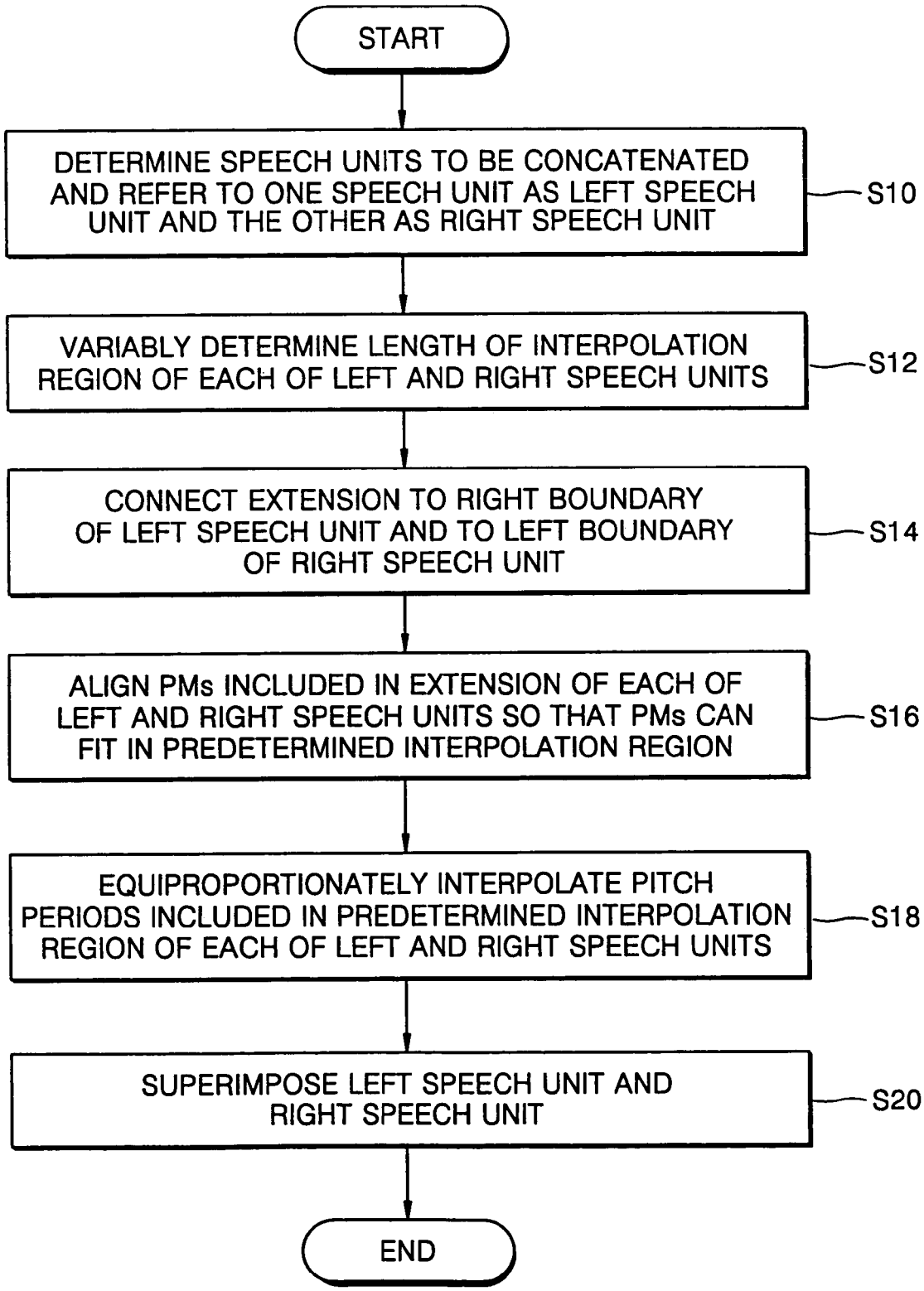
FIG. 1 is a flowchart for illustrating a speech synthesis method according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

The present invention relates to a speech synthesis method and a speech synthesis apparatus, in which speech units are concatenated using a DB, which is a collection of recorded and processed speech units. The speech units to be concatenated may be divided in unvoiced-unvoiced, unvoiced-voiced, voiced-unvoiced and voiced-voiced adjacent pairs. Since the smooth concatenation of voiced-voiced adjacent speech units is essential for high quality speech synthesis, the current method and apparatus concerns the concatenation of voiced-voiced speech units. Because voiced-voiced speech unit transitions appear in all languages, the methodology and apparatus can be applied to any language independently.

A Corpus-based speech synthesis process includes an off-line process of generating a DB for speech synthesis and an on-line process of converting an input text into speech using the DB.

The speech synthesis off-line process includes the following operations of selecting an optimum Corpus, recording the Corpus, attaching phoneme and prosody labels, segmenting the Corpus into speech units, compressing the data by using waveform coding methods, saving the coded speech data in the speech DB, extracting phonetic-acoustic parameters of speech units, generating a unit DB containing these parameters and optionally, pruning the speech and unit DBs in order to reduce their sizes.

The speech synthesis on-line process includes the following operations of inputting a text, pre-processing the input text, performing part of speech (POS) analysis, converting graphemes to phonemes, generating prosody data, selecting the suitable speech units based on their phonetic-acoustic parameters stored in the unit DB, performing prosody superimposing, performing concatenation and smoothing, and outputting a speech.

FIG. 1 is a flowchart for illustrating a speech synthesis method according to an embodiment of the present invention. Referring to FIG. 1, the interpolation-based speech synthesis method includes a to-be-concatenated speech unit determination operation S10, an interpolation region determination operation S12, a boundary extension operation S14, a pitch mark alignment operation S16, a pitch track interpolation operation S18, and a speech unit superimposing operation S20.

Figure 2:
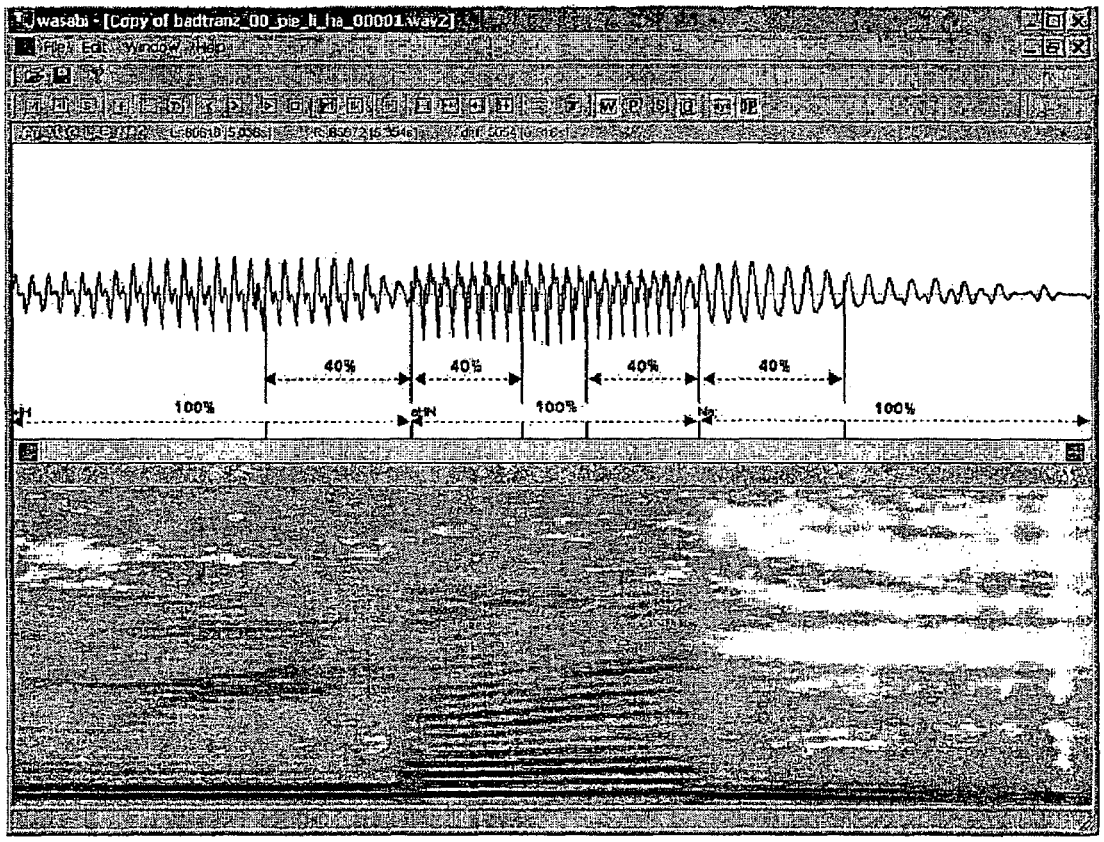
FIG. 2 shows a speech waveform and its spectrogram over an interval during which three speech units to be synthesized follow one after another.
Figure 3:
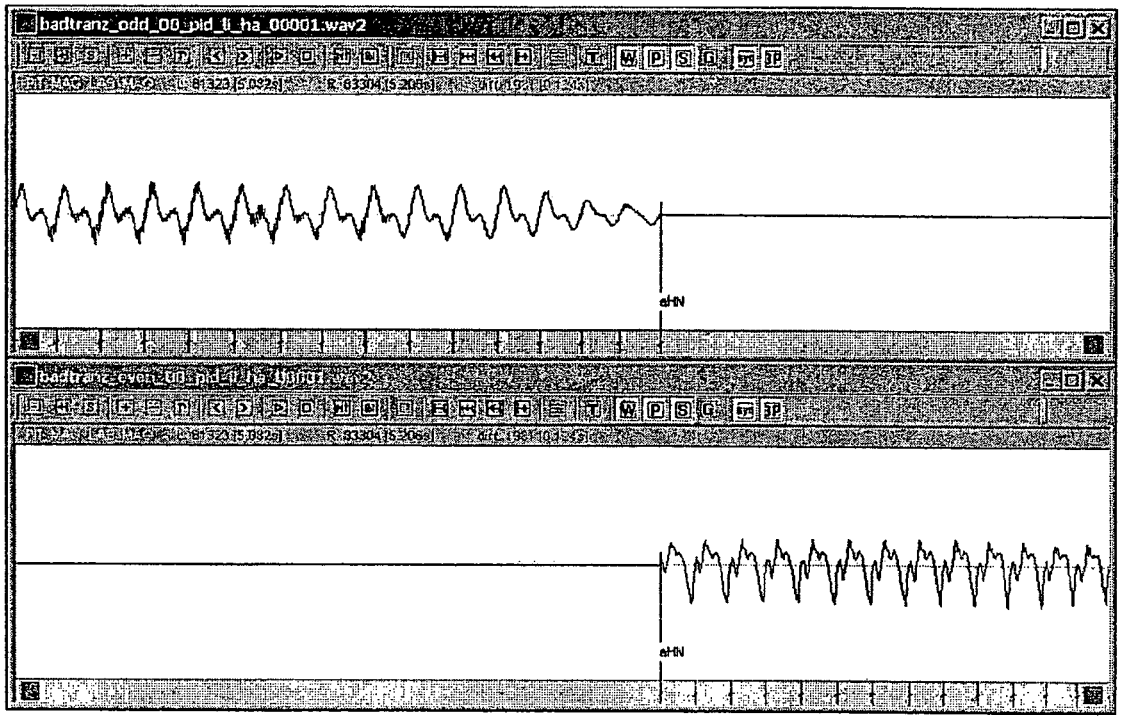
FIG. 3 separately shows a left speech unit and a right speech unit to be concatenated in operation S10 of FIG. 1.

In operation S10, speech units to be concatenated are determined, and one speech is referred to as a left speech unit and the other is referred to as a right speech unit. FIG. 2 shows a speech waveform and its spectrogram in an interval during which speech units, namely, three voiced phonemes, to be synthesized, follow one after another. Referring to FIG. 2, waveform mismatch and spectrogram discontinuity are found at boundaries between adjacent phonemes. Smoothing concatenation for a speech synthesis is performed in a quasi-stationary zone between voiced speech units. As shown in FIG. 3, two speech units to be concatenated are determined and divided with one as a left speech unit and the other as a right speech unit.

In operation S12, the length of an interpolation region of each of the left and right speech units is variably determined. An interpolation region of a phoneme to be concatenated with another phoneme is determined to be some percentage, but less than 40% of the overall length of the phoneme. Referring to FIG. 2, a region corresponding to the maximum 40% of the overall length of a phoneme is determined as an interpolation region of the phoneme. The percentage of the interpolation region of a phoneme from the overall length of the phoneme varies according to the specification of a speech synthesis system and the degree of mismatch between speech units to be concatenated.

In operation S14, an extension is attached to a right boundary of a left speech unit and to a left boundary of a right speech unit. The boundary extension operation S14 may be performed either by connecting extra-segmental data to the boundary of a speech unit or by repeating one pitch at the boundary of a speech unit.

Figure 4:
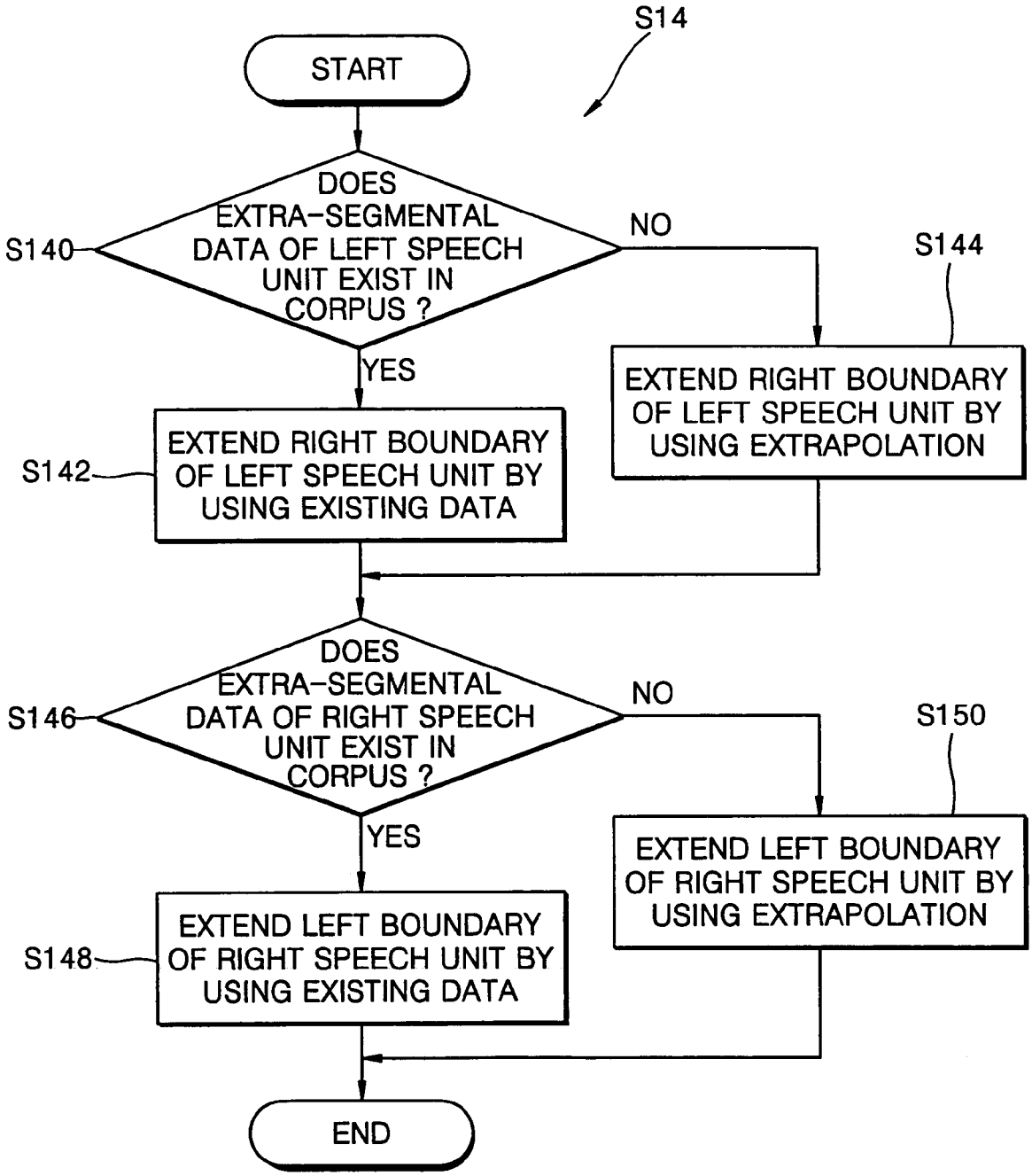
FIG. 4 is a flowchart illustrating an embodiment of operation S14 of FIG. 1.

FIG. 4 is a flowchart illustrating an embodiment of operation S14 of FIG. 1. The embodiment of operation S14 includes operations 140 through 150, which illustrate boundary extension in the case where the extra-segmental data of a left and/or right speech unit exists and boundary extension in the case where no extra-segmental data of the left and/or right speech unit exists.

Figure 5:
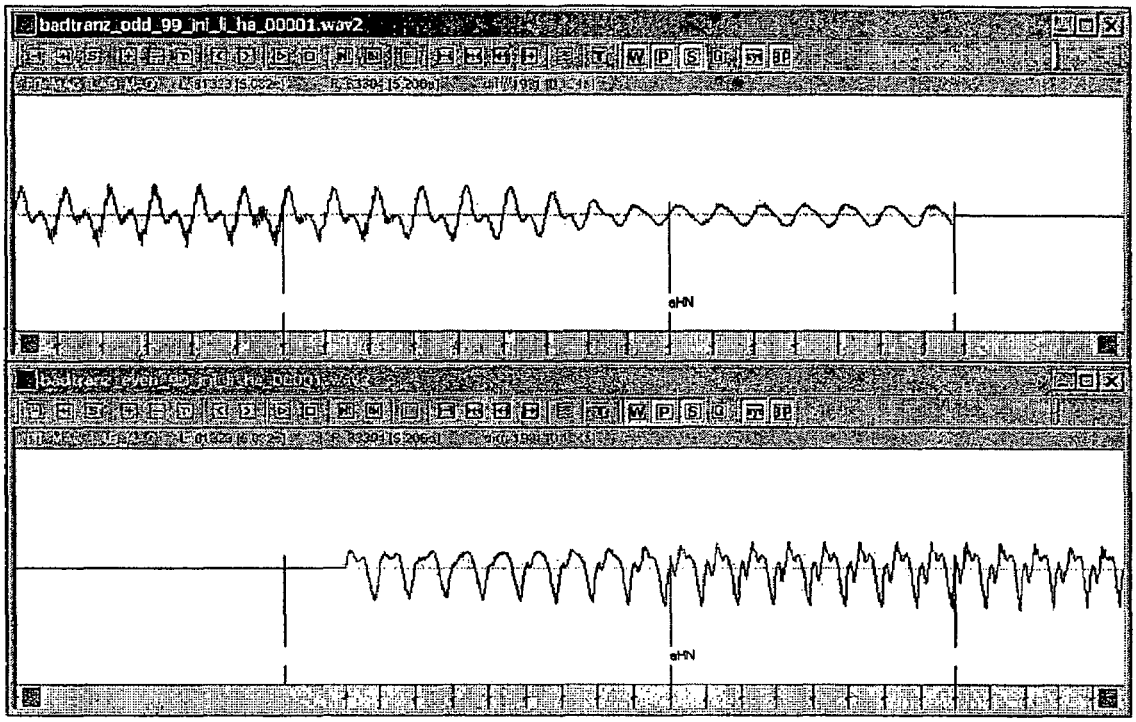
FIG. 5 shows an example of operation S14 of FIG. 1, in which using extra-segmental data extends the boundaries of two adjacent left and right units from FIG. 3.
Figure 6:
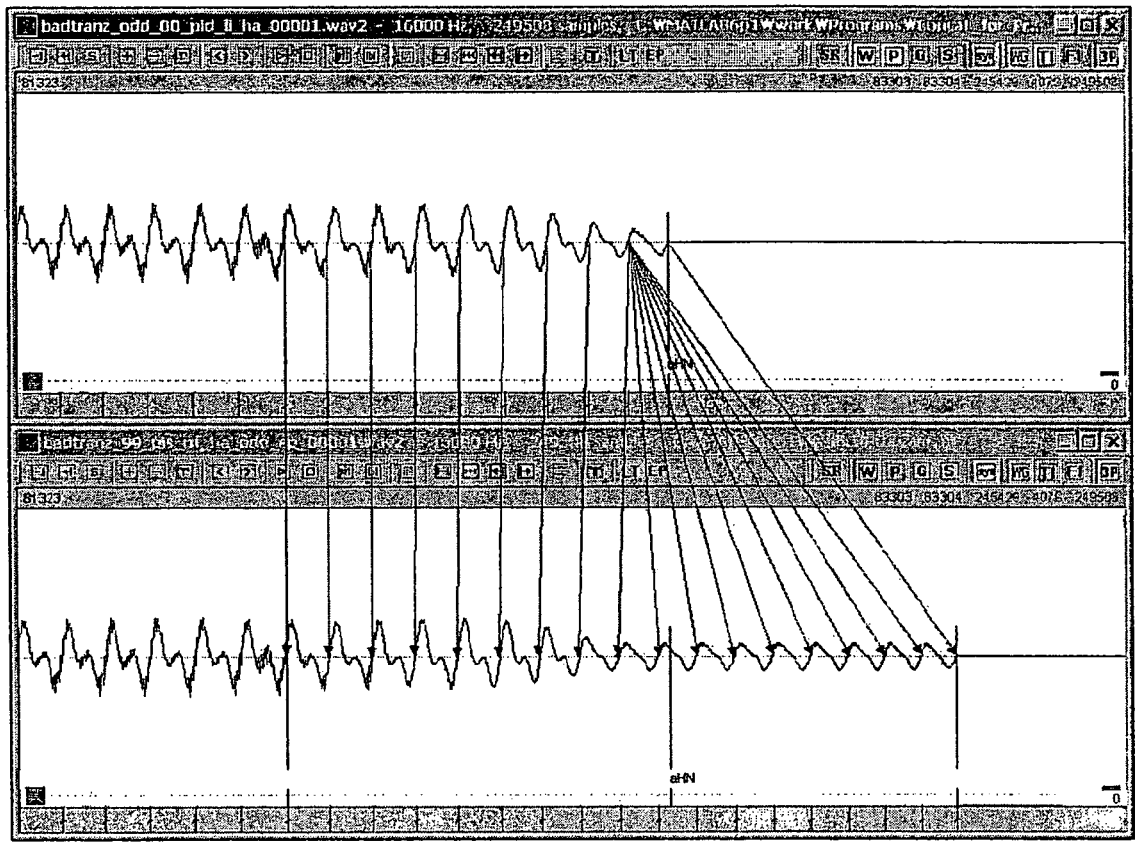
FIG. 6 shows an example of operation S14 of FIG. 1, in which a boundary of a left speech unit is extended by an extrapolation.
Figure 7:
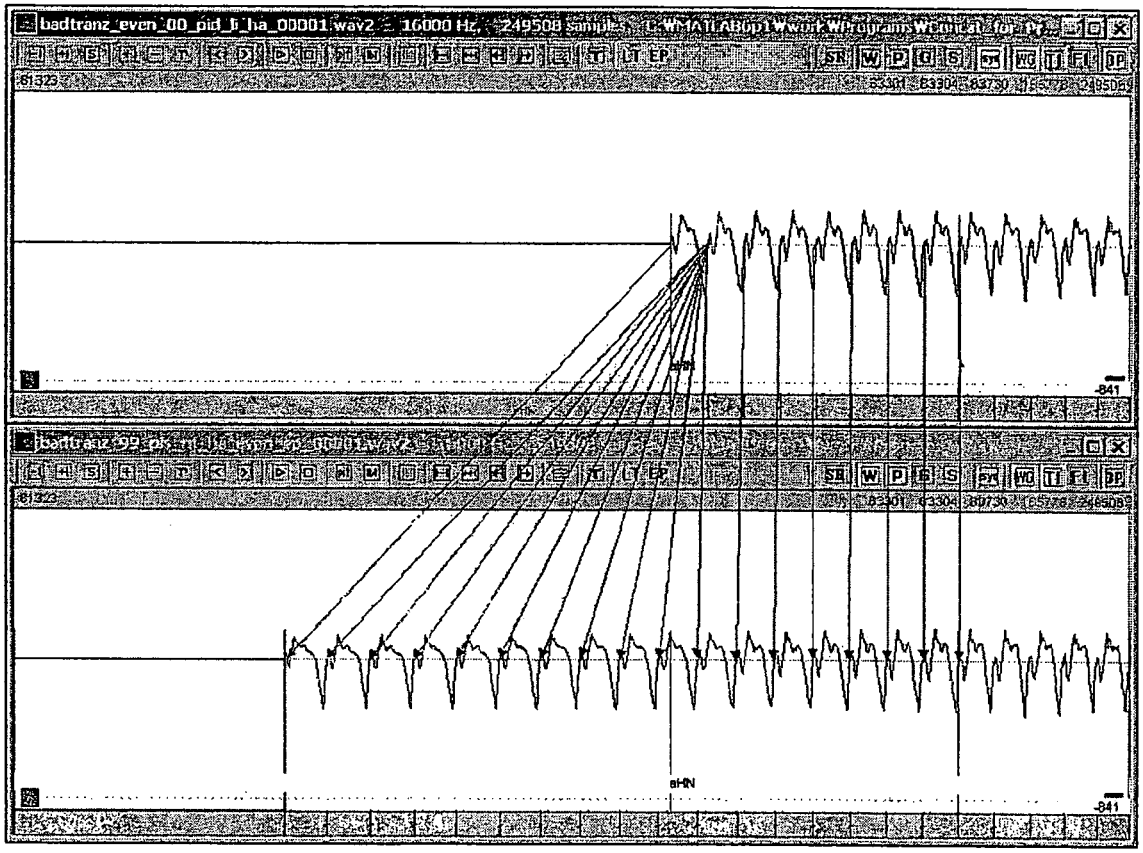
FIG. 7 shows an example of operation S14 of FIG. 1, in which a boundary of a right speech unit is extended by an extrapolation.

In operation S140, it is determined whether the extra-segmental data of a left speech unit exists in a DB. If the extra-segmental data of the left speech unit exists in the DB, the right boundary is extended and the extra-segmental data is loaded in operation S142. As shown in FIG. 5, if the extra-segmental data of a left speech unit exists, the left speech unit is extended by attaching as many extra-segmental data as the number of pitches in a predetermined interpolation region of a right speech unit to the right boundary of the left speech unit. On the other hand, if no extra-segmental data of the left speech unit exists, artificial extra-segmental data is generated in operation S144. As shown in FIG. 6, if no extra-segmental data of the left speech unit exists, the left speech unit is extended by repeating one pitch at its right boundary by the number of times corresponding to the number of pitches included in a predetermined interpolation region of the right speech unit. This process is equally applied for a right speech unit, as shown in FIGS. 5 and 7, in operations S146, S148, and S150.

Figure 8:
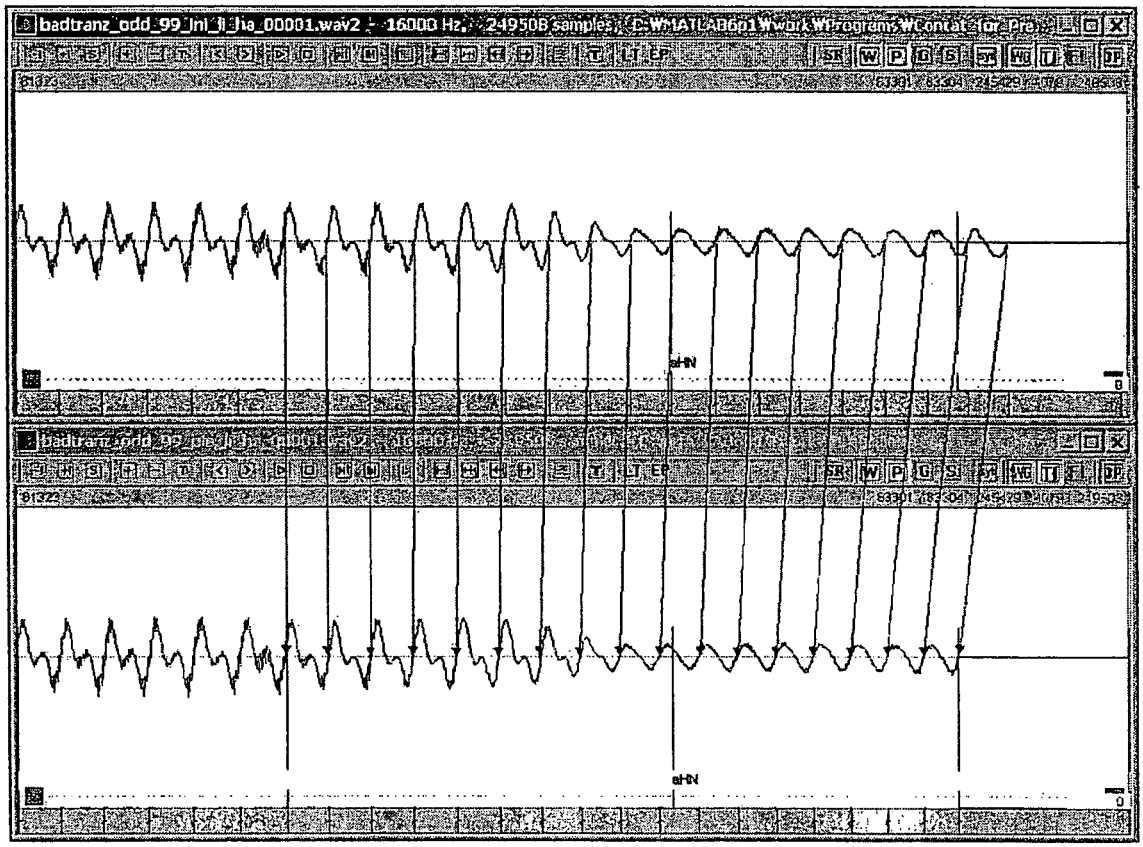
FIG. 8 shows an example of operation S16 of FIG. 1, in which pitch marks (PMs) are aligned by shrinking the pitches included in an extended portion of a left speech unit so that the pitches can fit in a predetermined interpolation region.
Figure 9:
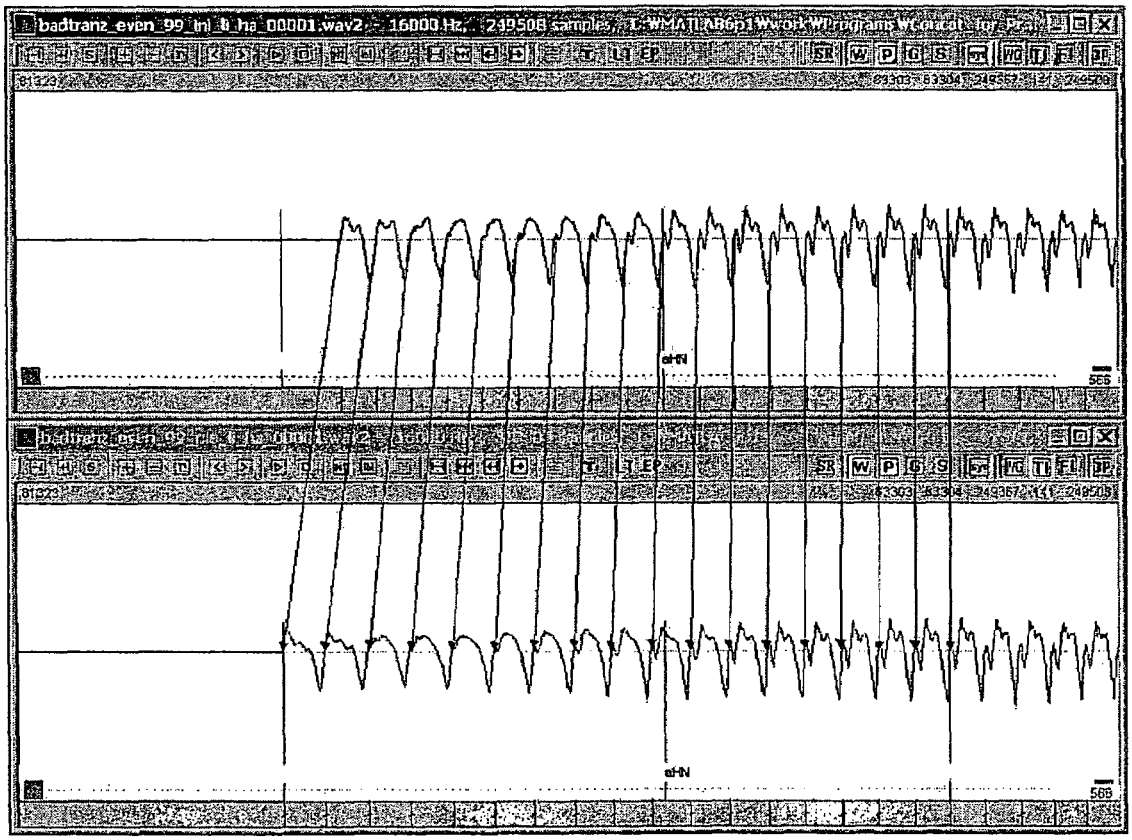
FIG. 9 shows an example of operation S16 of FIG. 1, in which pitch marks are aligned by expanding the pitches included in an extended portion of a right speech unit so that the pitches can fit in a predetermined interpolation region.

In operation S16, the locations of pitch marks included in an extended portion of each of the left and right speech units are synchronized and aligned to each other so that the pitch marks can fit in a predetermined interpolation region. The pitch mark alignment operation S16 corresponds to a preprocessing operation for concatenating the left and right speech units. Referring to FIG. 8, the pitches included in the extended portion of the left speech unit are shrunk so as to fit in a predetermined interpolation region. Referring to FIG. 9, the pitches included in the extended portion of the right speech unit are expanded so as to fit in the predetermined interpolation region.

Figure 10:
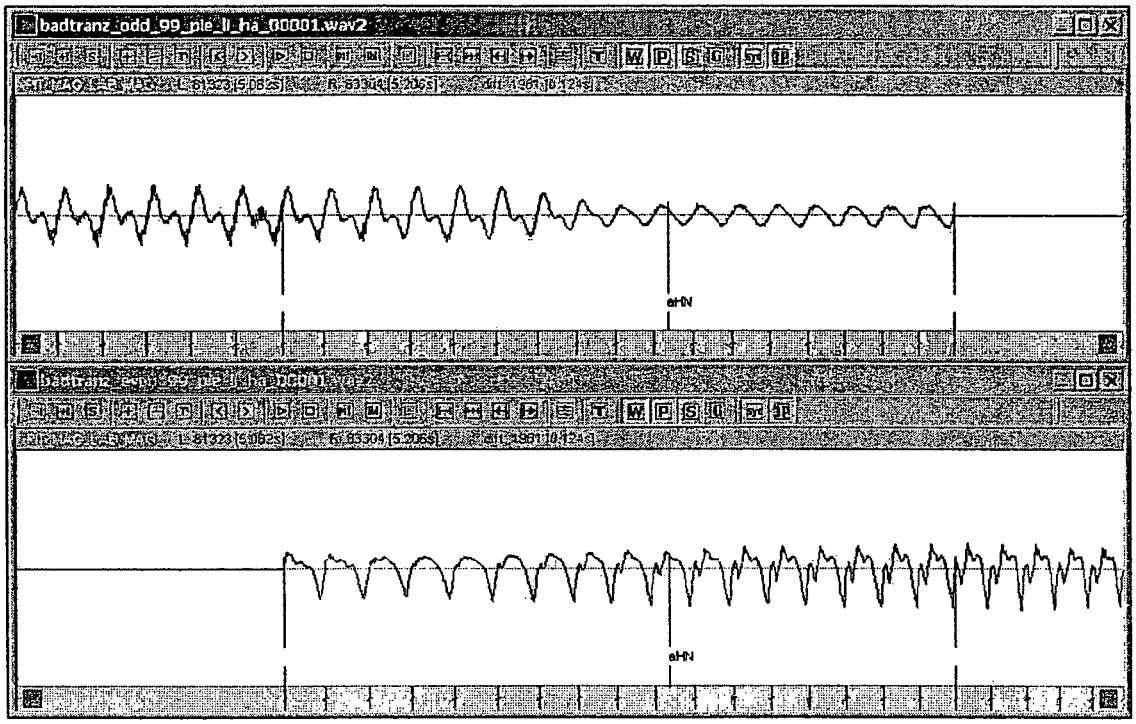
FIG. 10 shows an example of operation S18 of FIG. 1, in which the pitch periods in a predetermined interpolation region of each of left and right speech units are equi-proportionately interpolated.

The pitch track interpolation operation S18 is optional in the speech synthesis method according to the present invention. In operation S18, the pitch periods included in an interpolation region of each of left and right speech units are equi-proportionately interpolated. Referring to FIG. 10, the pitch periods included in an interpolation region of a left speech unit decrease at an equal rate in a direction from the left boundary of the interpolation region to the right boundary thereof. Also, the pitch periods included in an interpolation region of a right speech unit decrease at an equal rate in a direction from the left boundary of the interpolation region to the right boundary thereof. Moreover individual pairs of pitches of left and right unit in the interpolation region keep synchronism and individual pairs of pitch marks are keeping their alignment.

Figure 11:
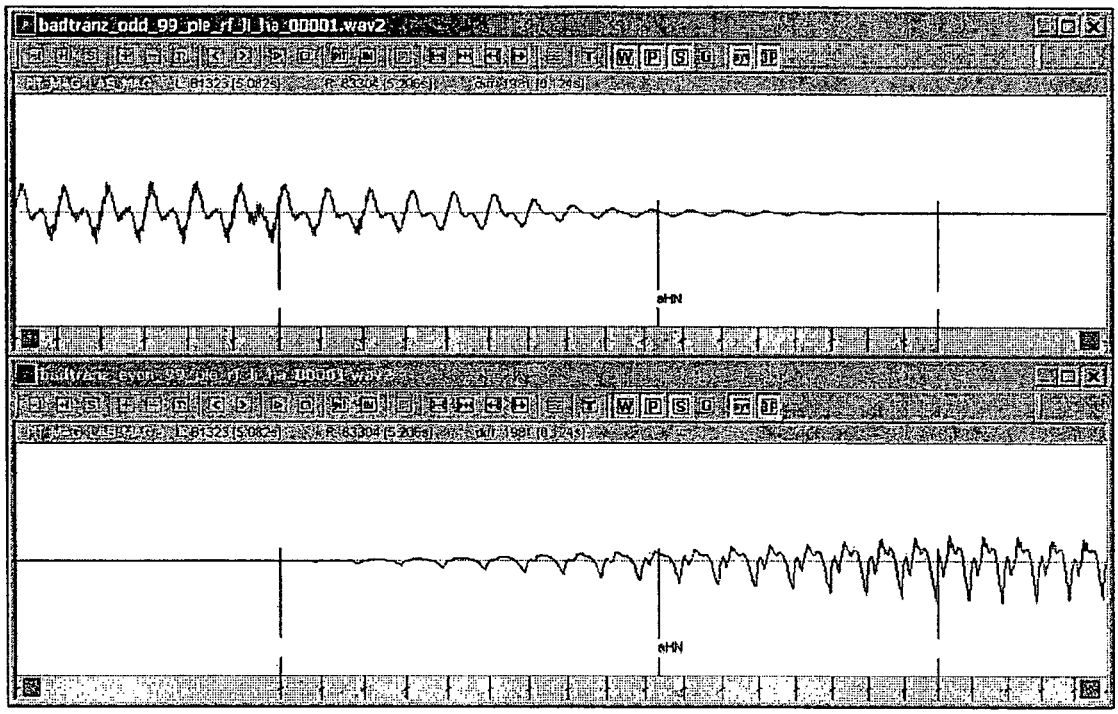
Figure 12:
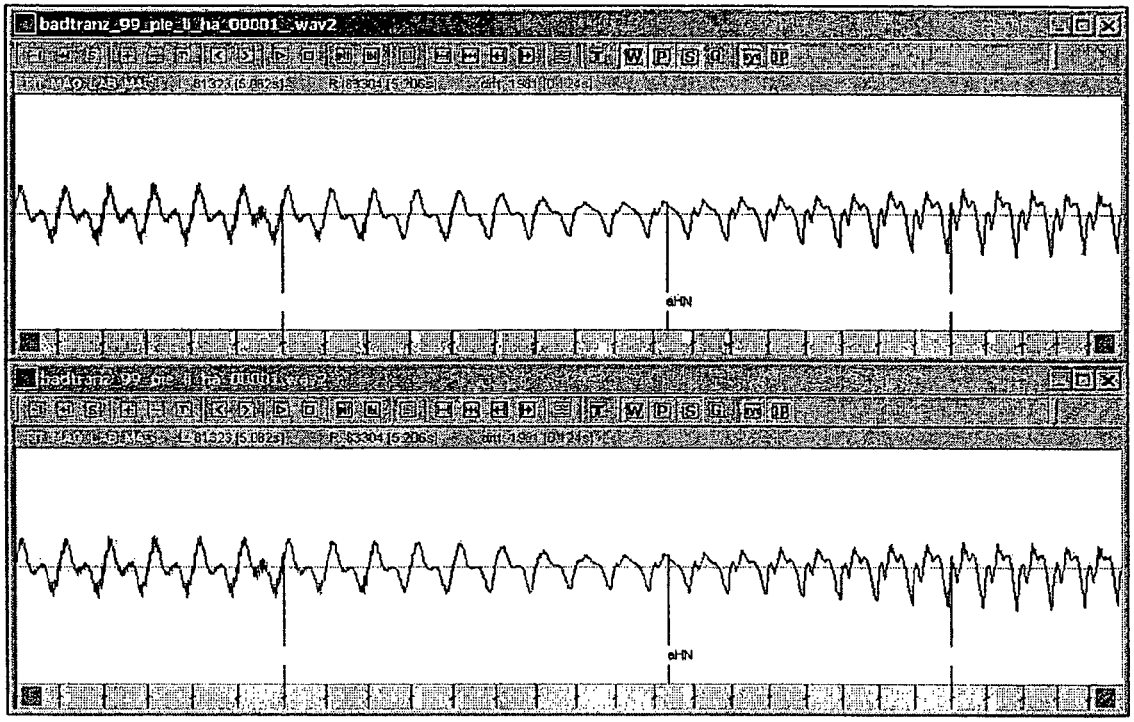
FIG. 12 shows waveforms in which the left and right speech units of FIG. 11 are superimposed.
Figure 13:
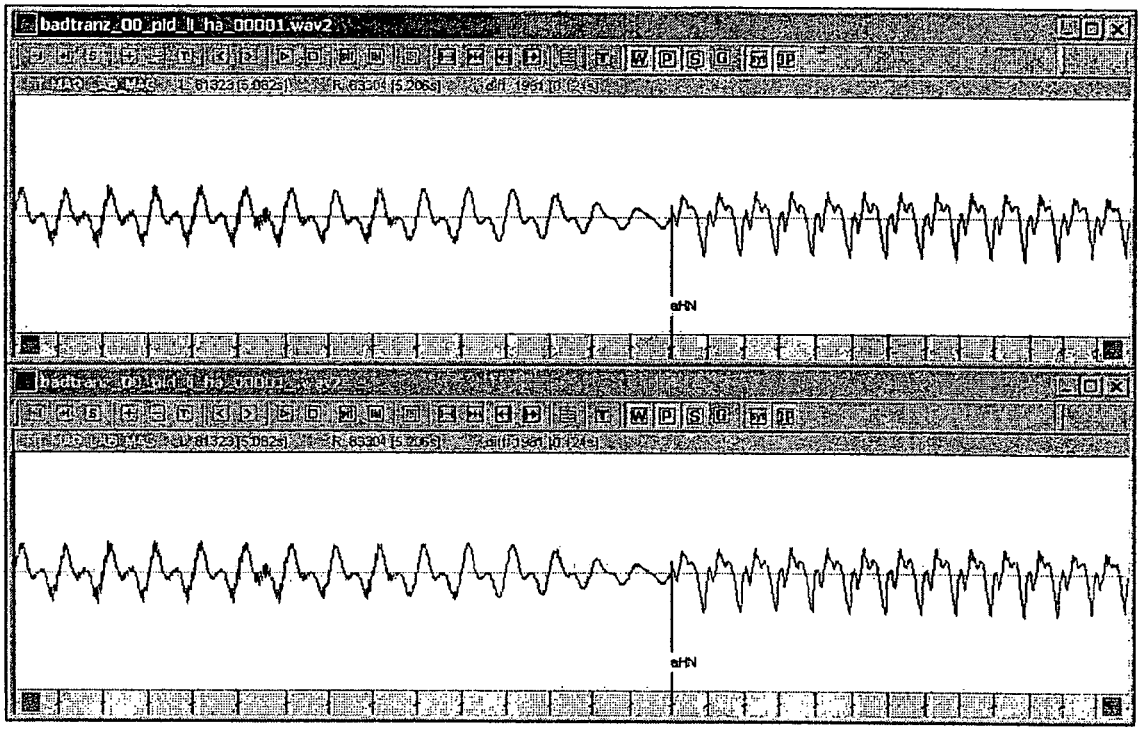
FIG. 13 shows waveforms in which phonemes are concatenated without undergoing a smoothing process.

In the speech unit superimposing operation S20, the left speech unit and the right speech unit are superimposed. The speech unit superimposing can be performed by a fading-in/out operation. FIG. 11 shows a waveform in which a predetermined interpolation region of a left speech unit fades out and a waveform in which a predetermined interpolation region of a right speech unit fades in. FIG. 12 shows waveforms in which the left and right speech units of FIG. 11 are superimposed. As for comparison, FIG. 13 shows waveforms in which phonemes are concatenated without undergoing a smoothing process. As shown in FIG. 13, a rapid waveform change occurs at a concatenation boundary between the left and right speech units. In this case, a coarse and discontinued voice is produced. On the other hand, FIG. 12 shows a smooth concatenation of the left and right speech units without a rapid waveform change.

Figure 14:
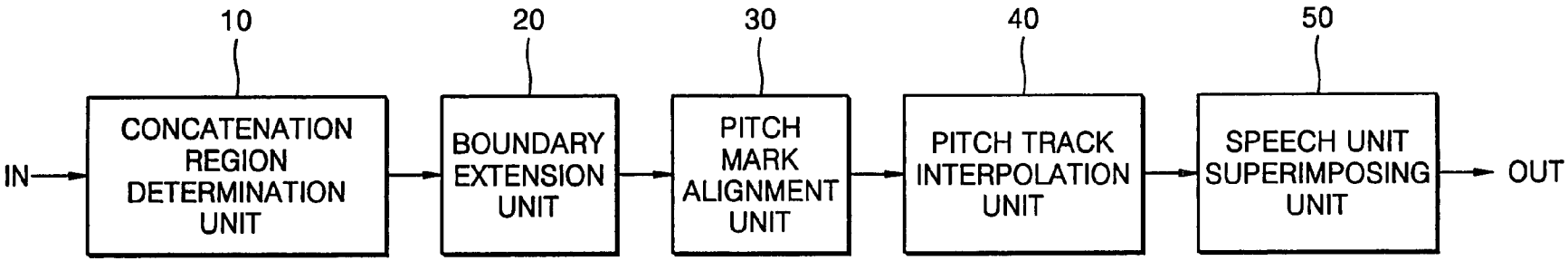
FIG. 14 is a block diagram of a speech synthesis apparatus according to the present invention for concatenating speech units based on a DB.

FIG. 14 is a block diagram of a speech synthesis apparatus according to the present invention. The speech synthesis apparatus of FIG. 14 includes a concatenation region determination unit 10, a boundary extension unit 20, a pitch mark alignment unit 30, and a speech unit superimposing unit 50.

The speech synthesis apparatus according to the present invention concatenates speech units using a DB. The concatenation region determination unit 10 performs operations S10 and S12 of FIG. 1 by determining speech units to be concatenated, dividing the determined speech units into a left speech unit and a right speech unit, and variably determining the length of an interpolation region of each of the left and right speech units. The speech units to be concatenated are voiced phonemes.

The boundary extension unit 20 performs operation S14 of FIG. 1 by attaching an extension to the boundary of each of the left and right speech units. More specifically, the boundary extension unit 20 determines whether extra-segmental data of each of the left and right speech units exists in a DB. If the extra-segmental data of each of the left and right speech units exists in the DB, the boundary extension unit 20 extends the boundary of each of the left and right speech units by using existing extra-segmental data in the DB. If no extra-segmental data of each of the left and right speech units exists in the DB, the boundary extension unit 20 extends the boundary of each of the left and right speech units by using extrapolation.

The pitch mark alignment unit 30 performs operation S16 of FIG. 1 by aligning the pitch marks included in the extension so that the pitch marks can fit in the predetermined concatenation region.

The speech unit superimposing unit 50 performs operation S20 of FIG. 1 by superimposing the left and right speech units whose pitch marks have been aligned. The speech unit superimposing unit 50 can superimpose the left and right speech units, after fading out the left speech unit and fading in the right speech unit.

The speech synthesis apparatus according to the present invention may include a pitch track interpolation unit 40, which receives pitch track and waveform data from the pitch mark alignment unit 30, equi-proportionately interpolates the periods of the pitches included in the interpolation region, and outputs the result of equi-proportionate interpolation to the speech unit superimposing unit 50.

As described above, in the Corpus based speech synthesis method according to the present invention, a determination of whether extra-segmental data exists or not is made, and smoothing concatenation is performed using either existing data or an extrapolation depending on a result of the determination. Thus, an acoustical mismatch at the concatenation boundary between two speech units can be alleviated, and a speech synthesis of good quality can be achieved. The speech synthesis method according to the present invention is effective in systems having a large- and medium-size DB but more effective in systems having a small-size DB by providing a natural and desirable speech.

A speech obtained by smoothing concatenation proposed by the present invention is compared with a speech obtained by simple concatenation, through a total of 15 questionnaires, the number obtained by conducting 3 questionnaires for 18 people each. Table 1 shows the result of the 15 questionnaires, in each of which a participant listens to a speech produced by a simple concatenation (i.e., concatenation without smoothing), a speech produced by a smoothing concatenation based on interpolation using extra-segmental data, and a speech produced by a smoothing concatenation based on interpolation of extrapolated data and then evaluate the three speeches using 1 to 5 preference points.

TABLE 1

| | Total number of points | Average |
|---|---|---|
| Concatenation without smoothing | 57 | 1.055 |
| Smoothing concatenation using interpolation with extra-segmental data | 233 | 4.314 |
| Smoothing concatenation using interpolation of extrapolated data | 242 | 4.481 |

The method and apparatus for reduction of acoustical mismatch between phonemes is suitable for language-independent implementation.

The present invention is not limited to the embodiments described above and shown in the drawings. Particularly, the present invention has been described above by focusing on a smoothing concatenation between voiced phonemes in speech synthesis. However, it is apparent that the present invention can also be applied when one-dimensional quasi-stationary one-dimensional signals are smoothed and concatenated in a field other than the speech synthesis field.

The aforementioned method of smoothing concatenation of speech units may be embodied as a computer program that can be run by a computer, which can be a general or special purpose computer. Thus, it is understood that the speech synthesis apparatus can be such a computer. Codes and code segments, which constitute the computer program, can be easily reasoned by a computer programmer in the art. The program is stored in a computer readable medium readable by the computer. When the program is read and run by a computer, the method of smoothing concatenation of speech units is performed. Here, the computer-readable medium may be a magnetic recording medium, an optical recording medium, a carrier wave, firmware, or other recordable media.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A speech synthesis method in which speech units are concatenated using a Corpus-based speech database (DB), the method comprising:

determining the speech units to be concatenated and dividing the speech units into a left speech unit and a right speech unit;

variably determining a length of a first interpolation region of the left speech unit and variably determining a length of a second interpolation region of the right speech unit;

attaching an extension to a right boundary of the left speech unit and an extension to a left boundary of the right speech unit;

aligning locations of pitch marks included in the extension of each of the left and right speech units so that the pitch marks can fit in a third interpolation region; and superimposing the left and right speech units, wherein the attaching comprises:

determining whether extra-segmental data of the left and/or right speech units exists in the speech database;

extending the right boundary of the left speech unit and the left boundary of the right speech unit by using existing data if the extra-segmental data exists in the speech database; and extending the right boundary of the left speech unit and the left boundary of the right speech unit by using an extrapolation if no extra-segmental data exists in the speech database.

2. The speech synthesis method of claim 1, wherein the speech units to be concatenated are voiced phonemes.

3. The speech synthesis method of claim 2, wherein the lengths of the first and second interpolation regions are less than 40% of an overall length of the voiced phonemes.

4. The speech synthesis method of claim 1, wherein in the superimposing of the speech units, the left and right speech units are superimposed after the left speech unit fades out and the right speech unit fades in.

5. The speech synthesis method of claim 1, further comprising equi-proportionately interpolating pitch periods included in the third interpolation region, between the aligning of the pitch marks and the superimposing of the speech units.

6. A speech synthesis apparatus in which speech units are concatenated using a speech database, the apparatus comprising:

a concatenation region determination unit determining the speech units to be concatenated, dividing the speech units into a left speech unit and a right speech unit, and variably determining the length of an interpolation region of each of the left and right speech units;

a boundary extension unit attaching an extension to a right boundary of the left speech unit and an extension to a left boundary of the right speech unit;

a pitch mark alignment unit aligning locations of pitch marks included in the extension of each of the left and right speech units so that the pitch marks fit in a predetermined interpolation region; and a speech unit superimposing unit superimposing the left and right speech units, wherein the boundary extension unit determines whether extra-segmental data of the left and/or right speech units exists in the speech database, extends the right boundary of the left speech unit and the left boundary of the right speech unit either by using existing data if the extra-segmental data exists in the speech database, and extends the right boundary of the left speech unit and the left boundary of the right speech unit either by using an extrapolation if no extra-segmental data exists in the speech database.

7. The speech synthesis apparatus of claim 6, wherein the speech units to be concatenated are voiced phonemes.

8. The speech synthesis apparatus of claim 7, wherein the lengths of the interpolation regions are less than 40% of an overall length of the voiced phonemes.

9. The speech synthesis apparatus of claim 6, wherein the speech unit superimposing unit superimposes the left and right speech units after making the left speech unit fade out and the right speech unit fade in.

10. The speech synthesis apparatus of claim 6, further comprising a pitch track interpolation unit which receives a pitch waveform from the pitch mark alignment unit, equi-proportionately interpolates the periods of the pitches included in the interpolation region, and outputs the result of equi-proportionate interpolation to the speech unit superimposing unit.

11. A computer readable medium encoded with processing instructions performing a method of speech synthesis in which speech units are concatenated using a speech database, the method comprising:

determining the speech units to be concatenated and dividing the speech units into a left speech unit and a right speech unit;

variably determining a length of a first interpolation region of the left speech unit and variably determining a length of a second interpolation region of the right speech unit;

attaching an extension to a right boundary of the left speech unit and an extension to a left boundary of the right speech unit;

aligning locations of pitch marks included in the extension of each of the left and right speech units so that the pitch marks can fit in a third interpolation region; and superimposing the left and right speech units, wherein the attaching of the boundary extensions comprises:

determining whether extra-segmental data of the left and/or right speech units exists in the speech database;

extending the right boundary of the left speech unit and the left boundary of the right speech unit by using existing data if the extra-segmental data exists in the speech database; and extending the right boundary of the left speech unit and the left boundary of the right speech unit by using an extrapolation if no extra-segmental data exists in the speech database.

12. The computer readable medium of claim 11, wherein the speech units to be concatenated are voiced phonemes.

13. The speech synthesis method of claim 12, wherein the lengths of the first and second interpolation regions are less than 40% of an overall length of the voiced phonemes.

14. The computer readable medium of claim 11, wherein in the superimposing of the left and right speech units, the left and right speech units are superimposed after the left speech unit fades out and the right speech unit fades in.

15. The computer readable medium of claim 11, wherein between the aligning of the locations of the pitch marks and the superimposing of the left and right speech units, the method further comprises, equi-proportionately interpolating the pitch periods included in the predetermined interpolation region.

16. A speech synthesis apparatus comprising a boundary extension unit determining whether extra-segmental data of a left and/or right speech units exists in a speech database, and extending a right boundary of the left speech unit and the left boundary of the right speech unit either by using existing data if the extra-segmental data exists in the speech database or by using an extrapolation if no extra-segmental data exists in the speech database.

* * * * *

UNITED STATES PATENT AND TRADEMARK OFFICE

CERTIFICATE OF CORRECTION

PATENT NO. : 7,369,995 B2
APPLICATION NO. : 10/785113
DATED : May 6, 2008
INVENTOR(S) : Attila Ferencz et al.

It is certified that error appears in the above-identified patent and that said Letters Patent is hereby corrected as shown below:

First Page, Item (73) (Assignee), change “Electonics” to --Electronics--.

Signed and Sealed this

Thirtieth Day of September, 2008

JON W. DUDAS
*Director of the United States Patent and Trademark Office*